US006739481B2

(12) United States Patent
Meshberg

(10) Patent No.: US 6,739,481 B2
(45) Date of Patent: May 25, 2004

(54) SPRAY DISPENSING DEVICE WITH NOZZLE CLOSURE

(75) Inventor: Philip Meshberg, Palm Beach, FL (US)

(73) Assignee: Dispensing Patents International LLC, Boynton Beach, FL (US)

( * ) Notice: Subject to any disclaimer, the term of this patent is extended or adjusted under 35 U.S.C. 154(b) by 2 days.

(21) Appl. No.: 10/300,880

(22) Filed: Nov. 21, 2002

(65) Prior Publication Data

US 2003/0106901 A1 Jun. 12, 2003

Related U.S. Application Data

(60) Continuation-in-part of application No. PCT/US01/44806, filed on Nov. 30, 2001, which is a continuation-in-part of application No. 09/726,489, filed on Dec. 1, 2000, now Pat. No. 6,382,463, which is a continuation-in-part of application No. 09/258,945, filed on Mar. 1, 1999, now Pat. No. 6,247,613, which is a continuation-in-part of application No. 08/774,338, filed on Dec. 30, 1996, now Pat. No. 5,875,932, which is a division of application No. 08/419,499, filed on Apr. 10, 1995, now Pat. No. 5,620,113.

(51) Int. Cl.[7] ..... B65D 83/00
(52) U.S. Cl. ..... 222/153.11; 222/402.11
(58) Field of Search ..... 222/1, 153.11, 222/153.13, 153.14, 321.7, 321.9, 383.1, 402.11

(56) References Cited

U.S. PATENT DOCUMENTS 3,904,088 A * 9/1975 Milbourne, Sr. ..... 222/402.11
4,506,805 A * 3/1985 Marcon ..... 222/153.13
5,158,211 A * 10/1992 Meshberg ..... 222/153.06
5,158,233 A * 10/1992 Foster et al. ..... 239/333
5,603,434 A * 2/1997 von Schuckmann ... 222/153.14
5,620,113 A * 4/1997 Meshberg ..... 222/1
5,875,932 A * 3/1999 Meshberg ..... 222/153.13
6,247,613 B1 * 6/2001 Meshberg ..... 222/1
6,382,463 B2 * 5/2002 Meshberg ..... 222/1

* cited by examiner

*Primary Examiner*—Joseph A. Kaufman
(74) *Attorney, Agent, or Firm*—Kenyon & Kenyon

(57) ABSTRACT

In accordance with embodiments of the present invention, an apparatus includes an actuator with a spray nozzle and an opening adjacent the spray nozzle. The actuator dispenses spray through the spray nozzle when the actuator is depressed to operate a pump or an aerosol valve. Also included is a nozzle closure with a first projection and a second projection. The first projection fits into a first opening adjacent the spray nozzle thereby sealing the spray nozzle, while the second projection fits into a second opening, below the first opening, thereby locking the actuator. The nozzle closure has a hinge allowing pivotal movement of the nozzle closure from a closed position, at which the spray opening is open, to a closed position, at which the spray opening is closed. When in the closed position, a degree of opening resistance between the nozzle closure and the actuator may provide a measure of child-resistance.

23 Claims, 10 Drawing Sheets

SPRAY DISPENSING DEVICE WITH NOZZLE CLOSURE

CLAIM FOR PRIORITY/CROSS REFERENCE TO RELATED APPLICATIONS

This non-provisional application is a continuation-in-part of PCT Application Serial Number PCT/US01/44806 (filed Nov. 30, 2001), now WIPO International Publication No. WO 02/43872 A2 (published Jun. 6, 2002), which is a continuation-in-part of U.S. patent application Ser. No. 09/726,489 (filed Dec. 1, 2000), now U.S. Pat. No. 6,382,463 B2 (issued May 7, 2002), which is a continuation-in-part of U.S. patent application Ser. No. 09/258,945 (filed Mar. 1, 1999), now U.S. Pat. No. 6,247,613 B1 (issued Jun. 19, 2001), which is a continuation-in-part of U.S. patent application Ser. No. 08/774,338 (filed Dec. 30, 1996), now U.S. Pat. No. 5,875,932 (issued Mar. 2, 1999), which is a division of U.S. patent application Ser. No. 08/419,499 (filed Apr. 10, 1995), now U.S. Pat. No. 5,620,113 (issued Apr. 15, 1997), which are all incorporated by reference herein in their entirety.

TECHNICAL FIELD

The present invention relates to a spray dispensing device with a closure for the spray nozzle. In particular, the present invention relates to a nozzle closure which includes structure to provide a seal for a dispensing actuator to prevent air or contaminants from causing clogging and structure to lock the dispensing actuator when not in use and prevent accidental discharge.

BACKGROUND OF THE INVENTION

In U.S. Pat. No. 5,158,211 (the "'211 patent"), issued Oct. 27, 1992, a mechanism is disclosed for sealing the outlet nozzle of a spray actuator when the dispenser is not in use to prevent accidental discharge of liquid. The mechanism for sealing the dispensing orifice prevents drying of the contents of the container in the spray orifice, thereby preventing clogging of the spray orifice. However, the device disclosed in the '211 patent requires that the actuator be rotated to a non-dispensing position for the sealing device to seal the orifice. Furthermore, this device has a removable tab for the dispensing position. Such a removable tab leaves an opening in the actuator shroud which can be the repository for dirt or dust, which can interfere with operation of the actuator or nozzle.

In the applications listed above, embodiments of nozzle closures which are mounted for pivoting movement from a closed to an open position are used with a spray dispensing device. In the open position, the nozzle closure moves away from the spray nozzle on an actuator and a spray opening in a surrounding wall, allowing fluid to dispensed through the nozzle, as the actuator is depressed. In the closed position, the nozzle closure pivots into a position where a projection enters at least partially into the spray nozzle. The projection acts to seal the spray nozzle against air, thereby preventing drying of any fluid in the nozzle and reducing the chance that the spray nozzle will become clogged. The nozzle closure in these embodiments also serves to provide resistance against depression of the actuator, to prevent accidental discharge from the spray nozzle.

Although, these embodiments have proven effective, in some cases the projection does not provide sufficient resistance against accidental discharge, for example, in the case where the source of material for the spray nozzle is an aerosol valve, or, in the case of undesired actuation by children. Thus, there is a need for a better nozzle closure which more positively prevents accidental discharge.

DETAILED DESCRIPTION

Figure 1:
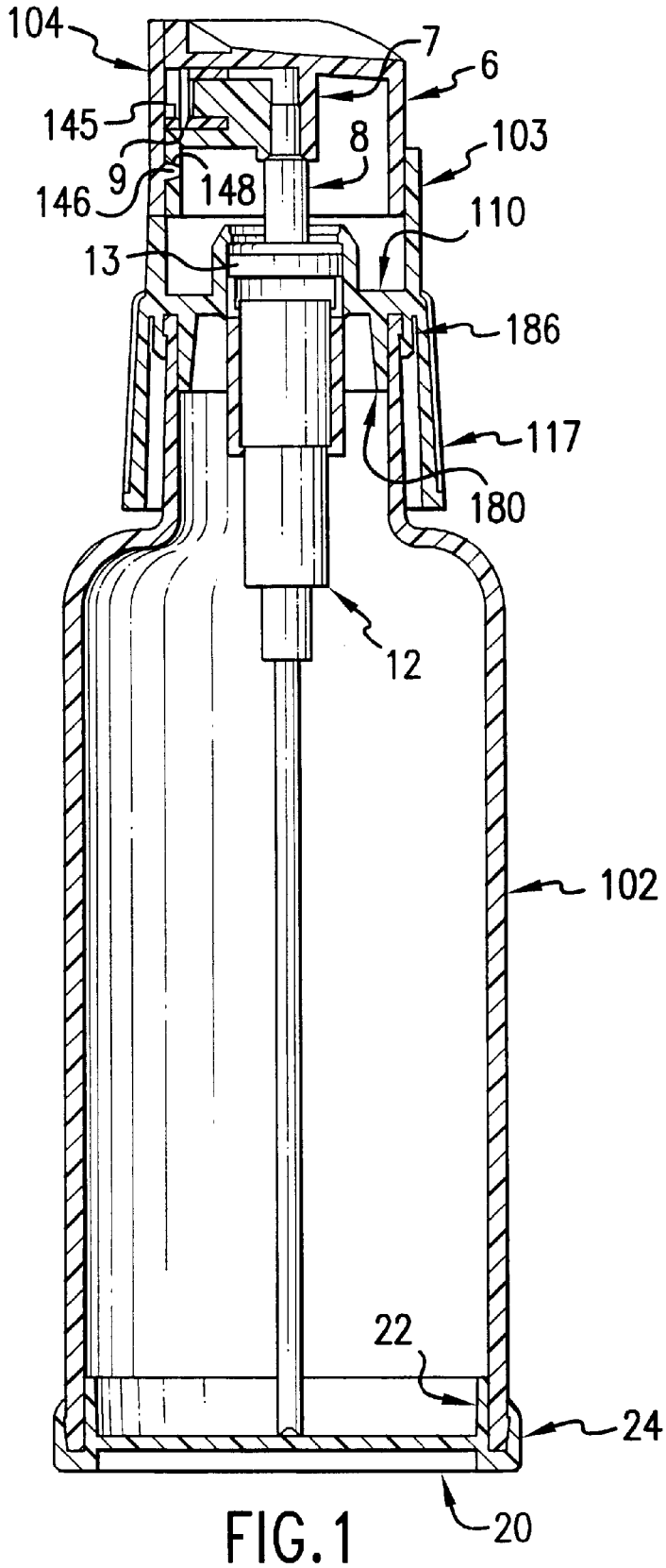
FIG. 1 is a cross-sectional view of an assembled package including an embodiment of a nozzle closure of the present invention.

In accordance with embodiments of the present invention, an apparatus includes an actuator with a spray nozzle and an opening adjacent the spray nozzle. The actuator dispenses spray through the spray nozzle when the actuator is depressed to operate a pump or an aerosol valve. Also included is a nozzle closure with a first projection and a second projection. The first projection fits into a first opening adjacent the spray nozzle thereby sealing the spray nozzle, while the second projection fits into a second opening, below the first opening, thereby locking the actuator. The nozzle closure has a hinge allowing pivotal movement of the nozzle closure from a closed position, at which the spray opening is open, to a closed position, at which the spray opening is closed. When in the closed position, a degree of opening resistance between the nozzle closure and the actuator may provide a measure of child-resistance.

FIGS. 1–4 show a container 102 with a mounting cap 117 which depicts an embodiment of the nozzle closure of the present invention. Details of the container 102 and mounting cap are described in U.S. Pat. Nos. 5,875,932 and 5,620,113, the disclosures of which patents are incorporated herein by reference. The mounting cap 117 shown in FIGS. 1–4 is particularly effective in ensuring a leakproof and easy-to-assemble mounting of pump 12 onto container portion 102 without the need for complicated molding of container portion 102. Mounting cap 117 includes an interior piston portion 180, which slides in and seals against an interior sealing surface of container portion 102. Actuator 6 includes a downwardly extending projection 7, in fluid communication with spray nozzle 9, which sealingly engages an upwardly projecting stem 8 of pump 12.

Container portion 102 also includes, at its upper end, an angled snap rim extending around the entire circumference of container portion 102. The snap rim includes a lower snap surface, and mounting cap 117 includes an exterior snap flange 186 which is used to secure and seal mounting cap 117 to container portion 102. The container portion 102 may include a bottom closure 20 with an inner piston portion 22 and an exterior snap flange 24.

Figure 2:
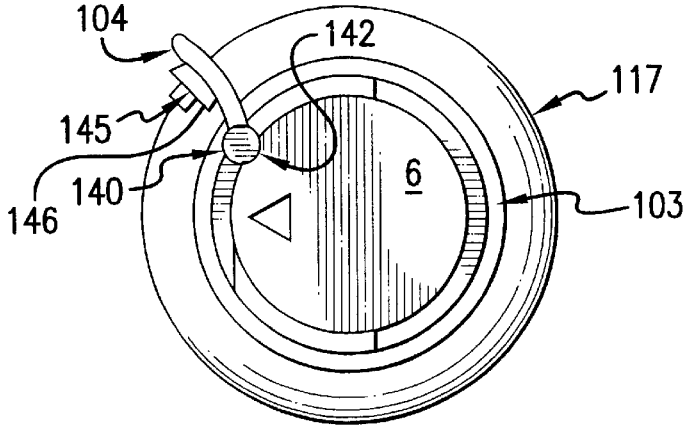
FIG. 2 is a top view of the nozzle closure of the embodiment of FIG. 1.
Figure 3:
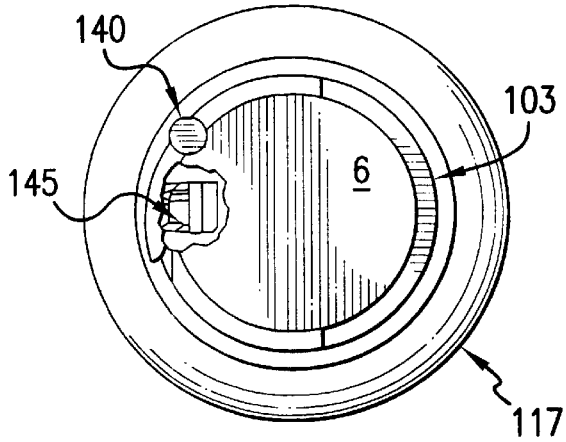
FIG. 3 is a partial cross-section of the view of FIG. 2.
Figure 4:
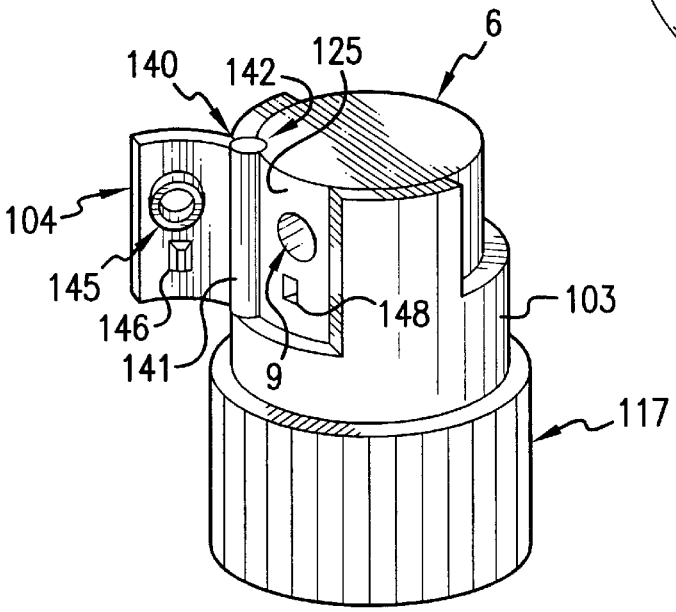
FIG. 4 is a perspective view of the nozzle closure of the embodiment of FIG. 1.

FIGS. 2–4 show details of an embodiment of the spray nozzle closure for sealing the nozzle 9 on actuator 6. An upstanding wall 103 on mounting cap 117 has mounted thereon, by way of a vertical hinge 140, a sealing finger 104. Hinge 140 can be of any known type, including a molded pin on upstanding wall 103 fitting within a hole in the cylindrical portion 141 of sealing finger 104. Through the mounting described above, since it is part of the mounting cap 117, wall 103 is mounted to container portion 102. This arrangement allows the sealing finger 104 to be detachably connected to the wall 103, which remains fixed to container portion 102. Cylindrical portion 141 of sealing finger 104 fits within a semi-circular recess 142 in actuator 6. The fit between cylindrical portion 141 and recess 142 ensures that actuator 6 may not be rotated such that spray nozzle 9 is not aligned with spray opening 125 in upstanding wall 103. Sealing finger 104 also includes a tapered projection 146. Actuator 6 has a matching recess 148.

Sealing finger 104, when it is desired to dispense fluid, in the form of spray, from container portion 102, is pivoted away from the spray nozzle 9, to the position shown in FIGS. 2 and 4. Thereafter, the actuator is depressed, and spray exits the spray nozzle 9 through spray opening 125. After dispensing, the sealing finger 104 is pivoted towards spray nozzle 9, so that a projection in the form of an annular sealing rim 145 engages in an opening adjacent the spray nozzle 9. This engagement seals the nozzle 9 from the encroachment of air or other debris into spray nozzle 9, thereby preventing clogging of the nozzle 9 between dispensing strokes. In the closed position, shown in FIG. 3, the sealing finger 104 completely covers spray opening 125. In this closed position the engagement of projection 146 with recess 148 acts to prevent the actuator 6 from being depressed, thereby locking the actuator 6 against accidental discharge. In this embodiment the hinge rotates about an axis parallel to the direction of actuation.

In order to advantageously impart a measure of child resistance to the operation of the nozzle closure, a degree of opening resistance can be provided for the sealing finger 104. A child may be required to use both hands to overcome the opening resistance and operate the sealing finger 104 from the closed position to the open position, e.g., by grasping container portion 102 in one hand while operating the sealing finger 104 with the other hand. For example, in order to operate the sealing finger 104 from the closed position to the open position, a predetermined amount of force can be required to overcome the friction developed between the contacting edges of the sealing finger 104 and the wall 103. In this case, a press fit can be created, between the sealing finger 104 and the wall 103, by slightly oversizing the sealing finger 104 relative to the spray opening 125. In another example, a predetermined amount of force can be required to overcome the friction developed between the contacting edges of the annular sealing rim 145 and the actuator 6. In this case, a press fit can be created between the annular sealing rim 145 and the actuator 6 by slightly oversizing the annular sealing rim 145 relative to the opening adjacent the spray nozzle 9. And, in a further example, a predetermined amount of force can be required to overcome the friction developed between the contacting edges of the projection 146 and actuator 6. In this case, a press fit can be created between the projection 146 and actuator 6 by slightly oversizing the projection 146 relative to the recess 148. Thus, a range of opening resistances can easily be created by varying the relative dimensions of the appropriate combinations of components.

Figure 5:
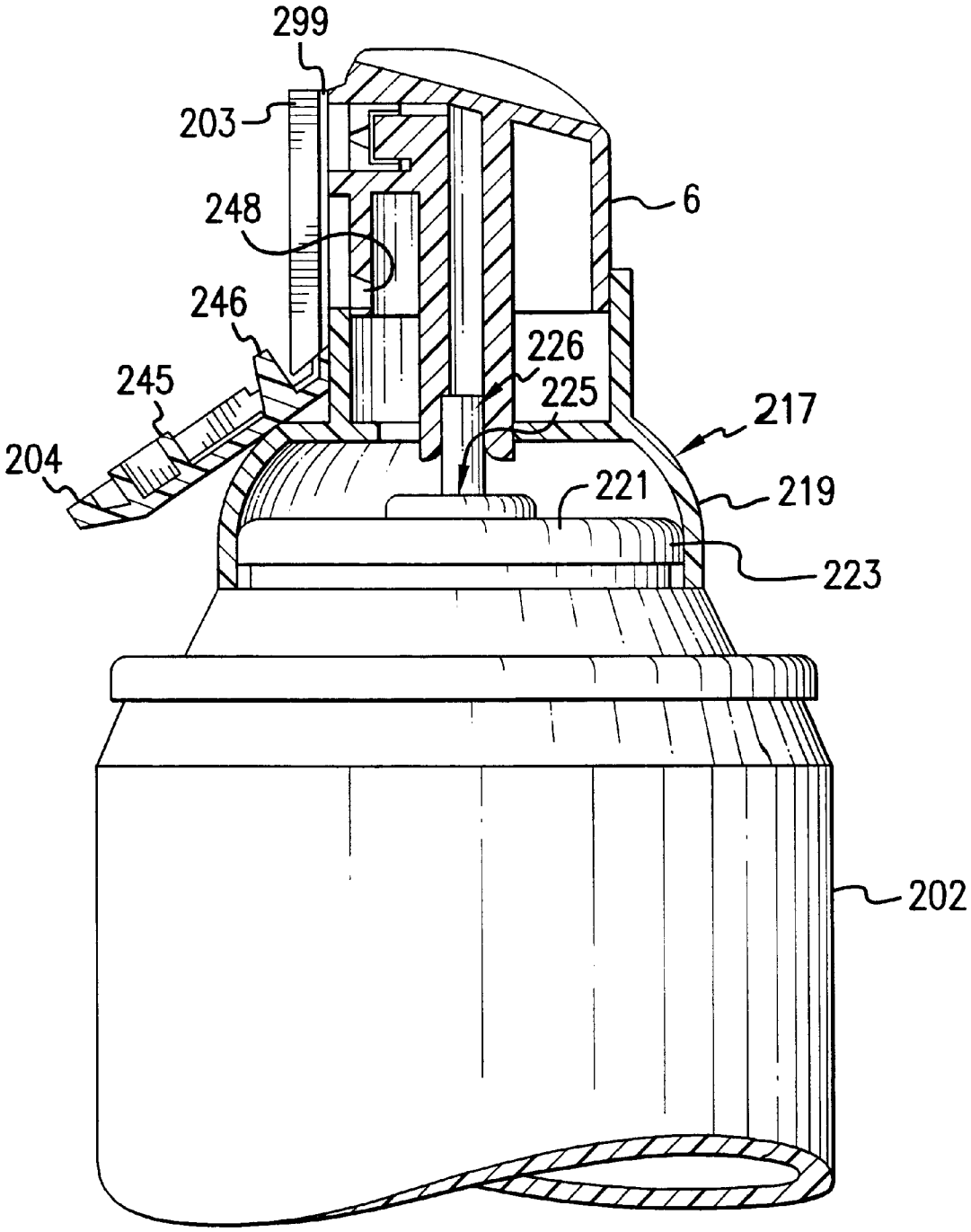
FIG. 5 is a side cross-sectional view of an embodiment of a nozzle closure of the present invention, in an open position.
Figure 6:
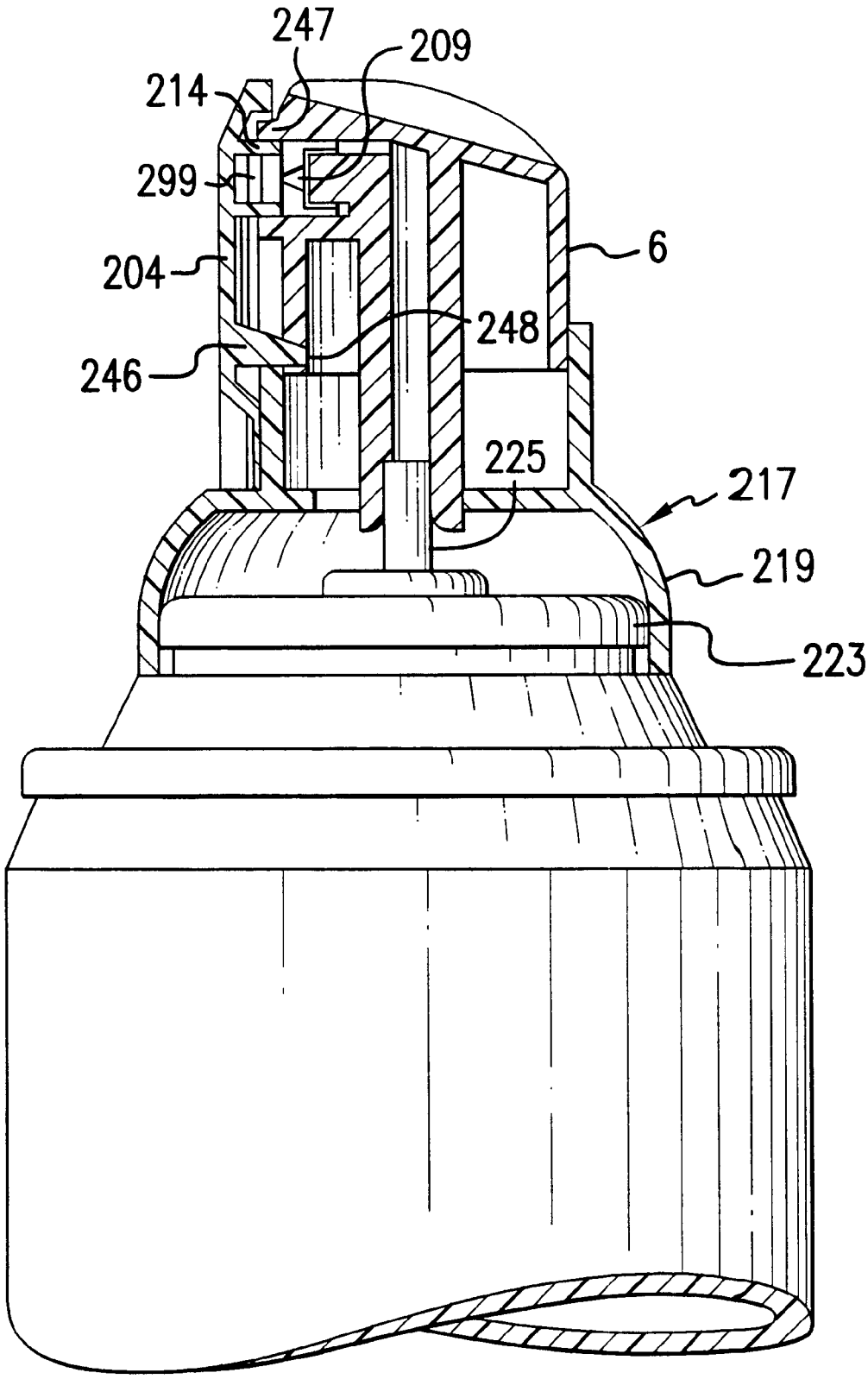
FIG. 6 is a side cross-sectional view of the embodiment of FIG. 5 in a closed position.

The embodiment of FIG. 1 is directed to a pump. However, the actuators with spray nozzles described herein may also be used with aerosol valves. A specific example of an embodiment of the present invention used with an aerosol valve is shown in FIGS. 5 and 6. FIGS. 5 and 6 show an aerosol container 202 with a mounting cap 217 which includes an embodiment of the nozzle closure of the present invention. The mounting cap 217 shown in FIGS. 5 and 6 includes a cylindrical skirt 219 which engages a beaded rim 223 of a mounting cup 221, at the top of the aerosol container 202, with a press fit attaching mounting cap 217, and with it wall 203, to container 202. Container 202 includes, at its upper end, a beaded rim 223 extending around its entire circumference. In conventional fashion, this is part of mounting cup 221. Mounting cup 221 contains an aerosol valve 225 with an upwardly projecting stem 226, and has, as its purpose, mounting the aerosol valve 225 and stem 226 to the top of container 202.

Figure 7:
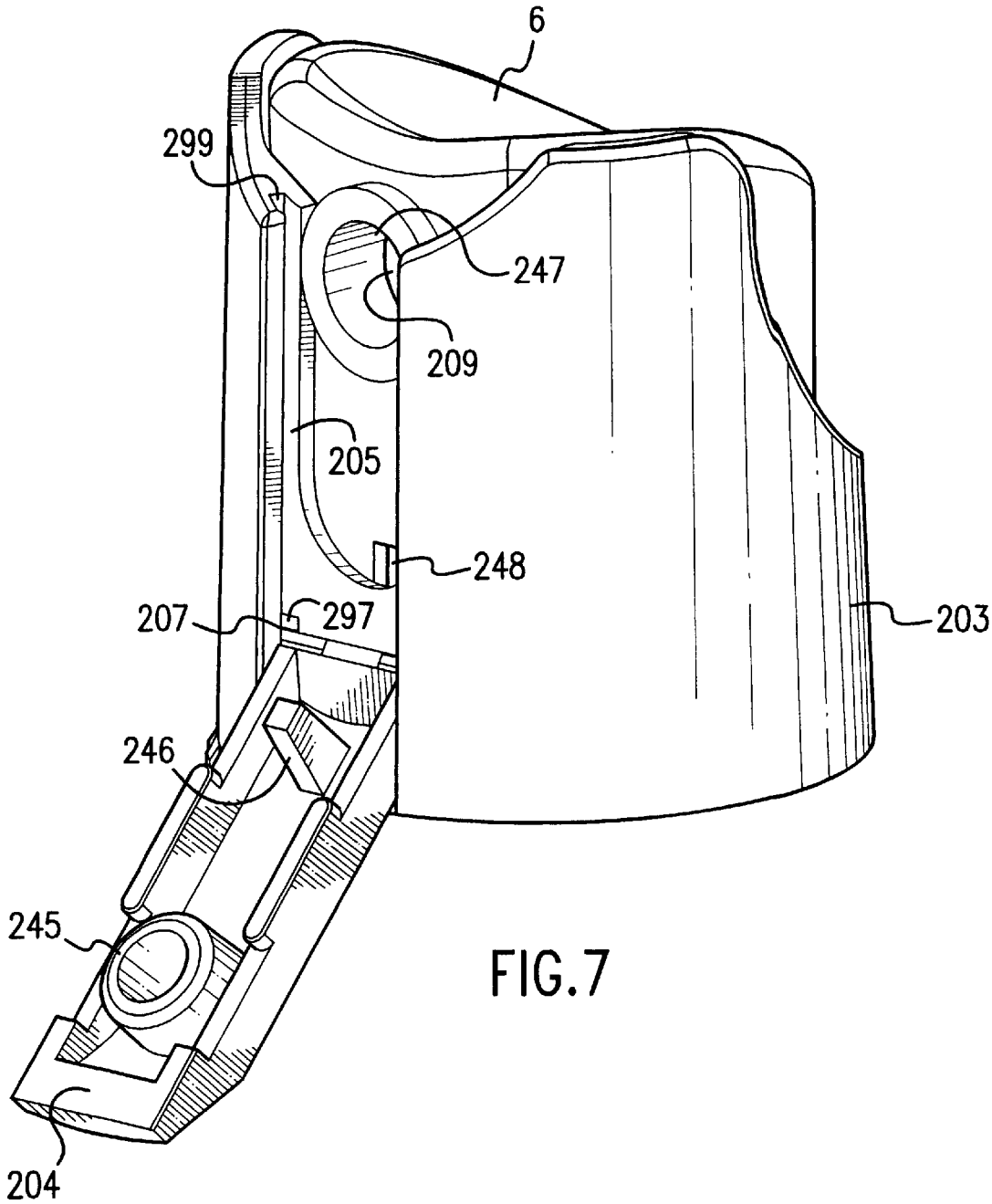
FIG. 7 is a perspective view of the nozzle closure of the embodiment of FIG. 5.

Sealing finger 204 is shown in the open position in FIG. 5 and in the closed position in FIG. 6. The construction of sealing finger 204 with its sealing rim 245 and its tapered projection 246 may be described with reference to FIG. 7. Sealing finger 204 includes a horizontal hinge 207 disposed at the base of slots 299 formed in wall portion 203 at opposing sides of opening 205. Wall portion 203 also includes a bump 297, past which hinge 207 must be pressed to prevent hinge 207 from coming out of slots 299 once it is pushed into place. Hinge 207 therefore allows sealing finger 204 to rotate relative to wall portion 203 from an open position (FIG. 5) to a closed position (FIG. 6). Sealing finger 204 includes a projection in the form of an annular sealing rim 245 which is shaped so as to sealingly fit within the opening 247 surrounding the spray orifice 209 on the actuator 6. Sealing finger 204 also includes a tapered projection 246 which is shaped so as to tightly fit within an opening 248 on the actuator 6 to positively prevent accidental discharge when the sealing finger 204 is in the closed position. Sealing finger 204 operates in a manner similar to the embodiment described with reference to FIGS. 1–4

Accordingly, in the position shown in FIG. 6, the annular sealing rim 245 projects into, and seals, the opening around the spray orifice 209, preventing air from entering the spray orifice 209. This sealing prevents any potential clogging of the spray orifice 209. At the same time, in the position shown in FIG. 5, the sealing finger 204 is moved to a position away from the spray orifice 209, where the sealing finger 204 will not interfere with the spray from the spray orifice and does not block the spray opening 205.

Sealing finger 204 is designed so that front surface 208 lies flush with the outer surface of upstanding wall 203. As a result of the insertion of the hinge of the sealing finger into slots, sealing finger 204 is easily inserted into, and removed from, the mounting cap 217, thereby allowing easy interchangeability of sealing finger 204, so that sealing fingers 204 having different colors, different annular sealing rim 245 sizes and shapes, etc., may be placed on the mounting cap 217. This arrangement allows the sealing finger 204 to be detachably connected to the wall 203. Furthermore, sealing finger 204 completely fills the spray opening 205 when annular sealing rim 245 is engaged with the spray orifice 209 opening on the actuator 6 so that dirt, sand, or lint does not clog spray opening 205.

As noted above, the embodiment of FIGS. 5–7 also includes a feature for positively locking the actuator 6 against accidental discharge. Sealing finger 204 includes a projection 246 which fits in a recess 248 of actuator 6 when the sealing finger 204 is in the closed position (FIG. 6). The projection 246 in this position therefore prevents the actuator 6 from being depressed downwardly, thereby preventing accidental discharge from the spray orifice 209. In the open positions shown in FIGS. 5 and 7, the locking projection 246 moves away from the actuator 6, thereby allowing depression of the actuator 6 and spray dispensing through the spray orifice 209. Of course, a degree of opening resistance can be provided for sealing finger 204 in order to impart a measure of child resistance to the present invention. The slots 299 in wall 203 by means of which the hinge of the sealing finger 204 is retained are visible, as is the recess 248 into which projection 246 is inserted when the sealing finger 204 is closed. The manner in which sealing rim 245 fits into the recess 247 surrounding the nozzle is shown in FIG. 6. In this embodiment, with an aerosol valve, accidental actuation is more of a danger and the positive locking effect of projection 246 fitting into matching recess 248 is even more important.

Figure 8:
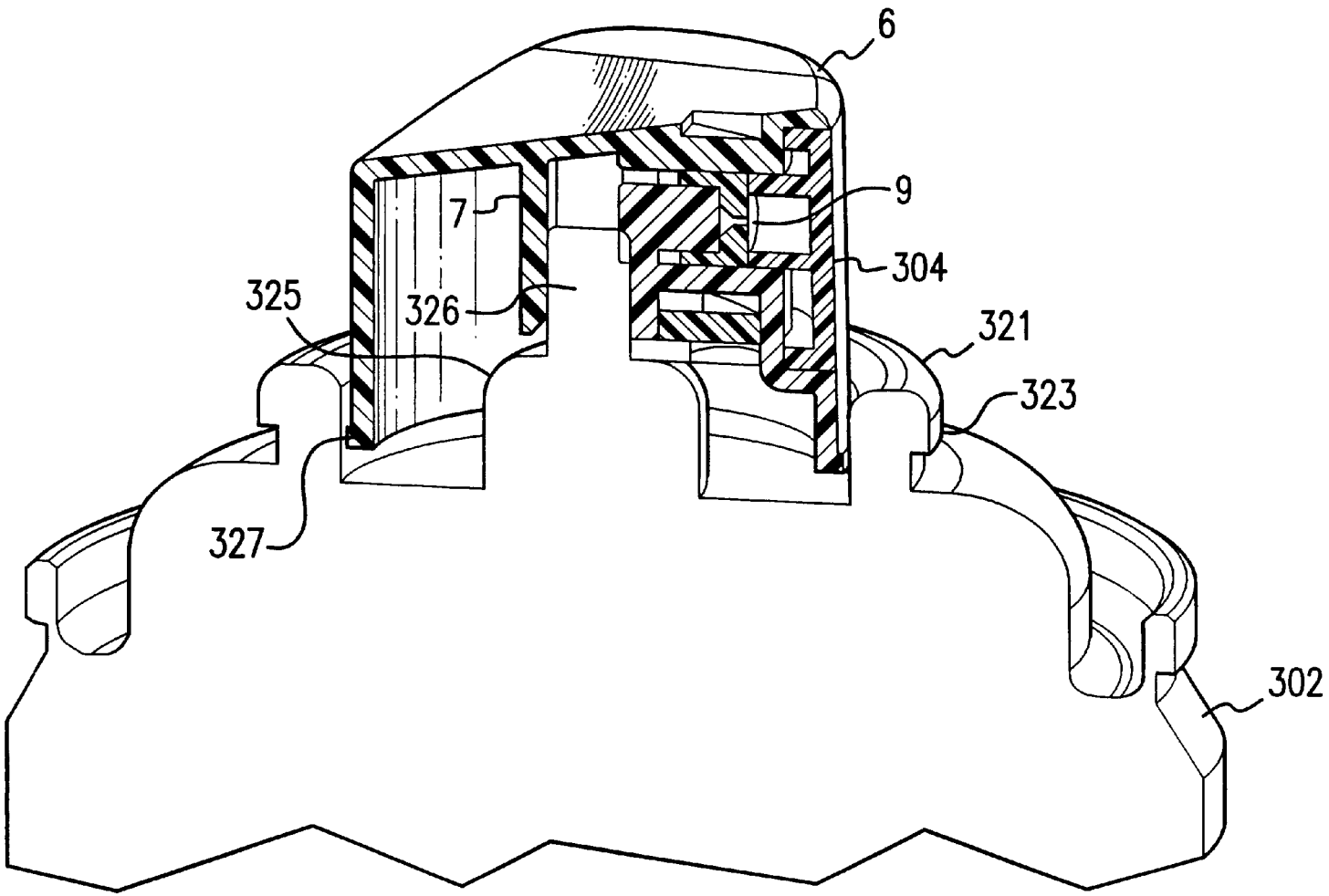
FIG. 8 is a cross-sectional view in partial perspective of a nozzle closure, according to an embodiment of the present invention.
Figure 9:
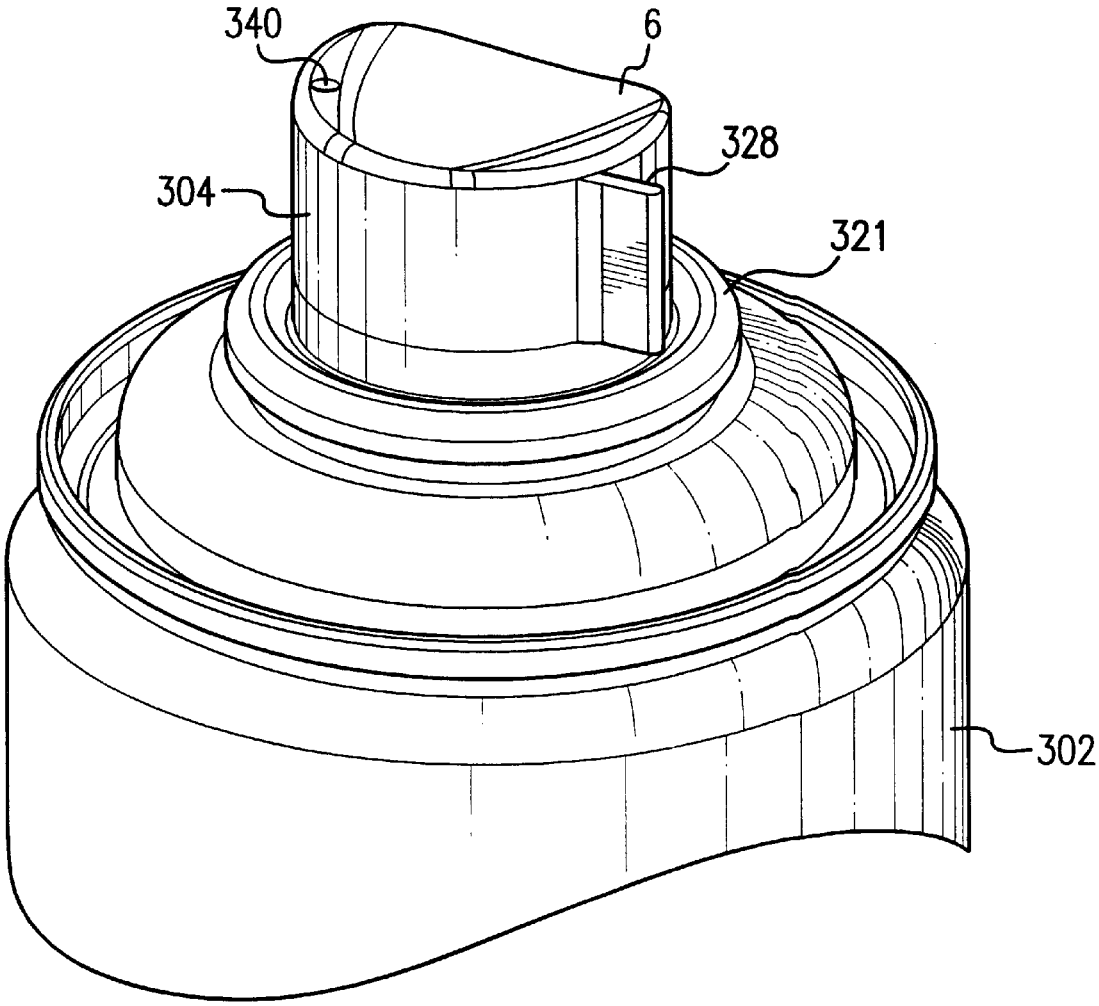
FIG. 9 is a perspective view of the nozzle closure of the embodiment of FIG. 8, in a closed position.
Figure 10:
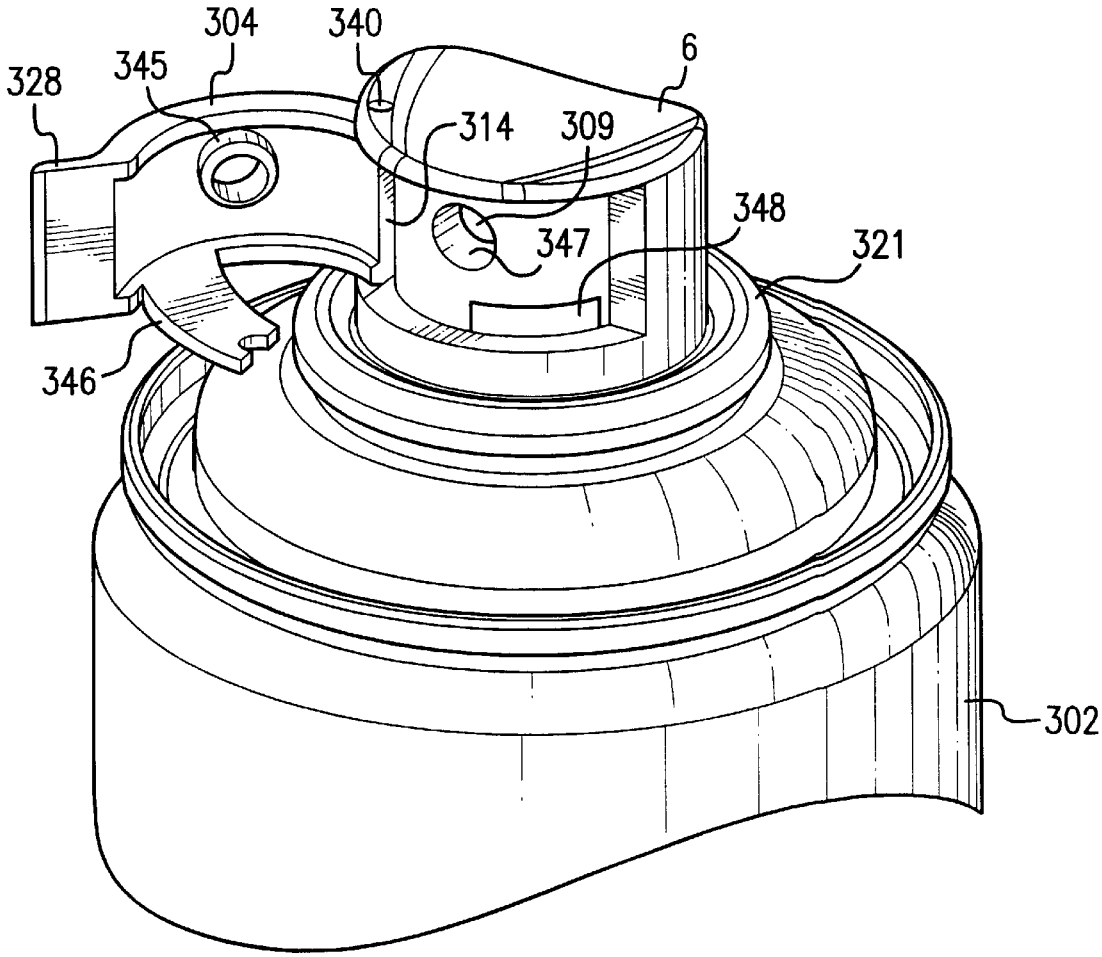
FIG. 10 is a perspective view of the nozzle closure of the embodiment of FIG. 8, in an open position.

Another specific example of an embodiment of the present invention used with an aerosol valve is shown in FIGS. 8–10. Referring to FIG. 8, a mounting cup 321, having a beaded rim 323, may be provided at the top of aerosol container 302. Generally, beaded rim 323 may extend around the entire circumference of aerosol container 302, and in conventional fashion, beaded rim 323 may be part of mounting cup 321. Mounting cup 321 may contain an aerosol valve 325 with an upwardly projecting stem 326, and may have, as its purpose, mounting the aerosol valve 325 and stem 326 of the top of aerosol container 302. Actuator 6 may include a downwardly extending projection 7, in fluid communication with spray orifice 309, to sealingly engage the upwardly projecting stem 326 of aerosol valve 325. A flange 327 may be provided to prevent actuator 6 from becoming loose from upwardly projecting stem 326. For example, in the embodiment depicted in FIG. 8, flange 327 may be located at the bottom of actuator 6 and extend partially into the area between actuator 6 and the inner surface of mounting cup 321. In this manner, excessive lateral or transverse motions of actuator 6 about upwardly projecting stem 326, which may weaken the engagement between downwardly extending projection 7 and upwardly projecting stem 326, may be prevented. A sealing finger 304 may be mounted on actuator 6 by way of hinge 340 (as depicted in FIGS. 9–10).

Hinge 340 may be of any known type, including, for example, molded pins on actuator 6 fitting within corresponding holes in the top and bottom of cylindrical portion 314 of sealing finger 304, molded pins on the top and bottom of cylindrical portion 314 of sealing finger 304 fitting within corresponding holes in actuator 6, etc. Generally, sealing finger 304 may be detachably connected to actuator 6, and, in one embodiment, cylindrical portion 314 of sealing finger 304 may fit within a semi-circular recess of actuator 6. Sealing finger 304 may include a projection in the form of an annular sealing rim 345 which may be shaped so as to sealingly fit within a matching opening 347 surrounding spray orifice 309 on actuator 6. Sealing finger 304 may also include a locking projection 346 and actuator 6 may include a matching opening 348.

Sealing finger 304 is shown in the closed position in FIGS. 8 and 9 and in the open position in FIG. 10. When sealing finger 304 is in the closed position, for example, locking projection 346 may fit into, and extend within, opening 348 to prevent actuation of actuator 6 and the accompanying dispensing of spray. However, when sealing finger 304 is in the open position, actuator 6 may be actuated freely (e.g., depressed), and spray may be dispensed. In other words, when sealing finger 304 is in the closed position, actuator 6 is "locked" and accidental discharge may be prevented. In an exemplary embodiment, when sealing finger 304 is in the closed position, a portion of the end of locking projection 346 may interpose between downwardly extending projection 7 and actuator valve 325, so that actuator 6 may not be depressed to dispense spray. In this embodiment, locking projection 346 physically obstructs the downward movement of actuator 6. Additionally, the end of locking projection 346 may be advantageously shaped to conform to the outer diameter of upwardly extending stem 326 (as shown in FIG. 10). Sealing finger 304 may also include an operating tab 328 to provide a convenient surface to operate sealing finger 304 from the closed position to the open position, as well as from the open position to the closed position.

Similar to the embodiments discussed above, when it is desired to dispense spray from aerosol container 302, sealing finger 304 is pivoted away from actuator 6 and spray orifice 309 to the position shown in FIG. 10, for example. Thereafter, actuator 6 may be depressed and spray may exit spray orifice 309. After dispensing, sealing finger 304 may be pivoted towards spray opening 309, so that annular sealing rim 345 engages within spray opening 309, and locking projection 346 engages within opening 348. When in the closed position, such as is depicted in FIG. 9 for example, sealing finger 304 completely fills spray opening 305 and annular sealing rim 345 engages with, and seals, spray orifice 309 so that dirt, sand, or lint does not clog spray orifice 309. Furthermore, the engagement of locking projection 346 with opening 348 advantageously prevents actuator 6 from being depressed, thereby locking actuator 6 against accidental discharge.

Figure 11:
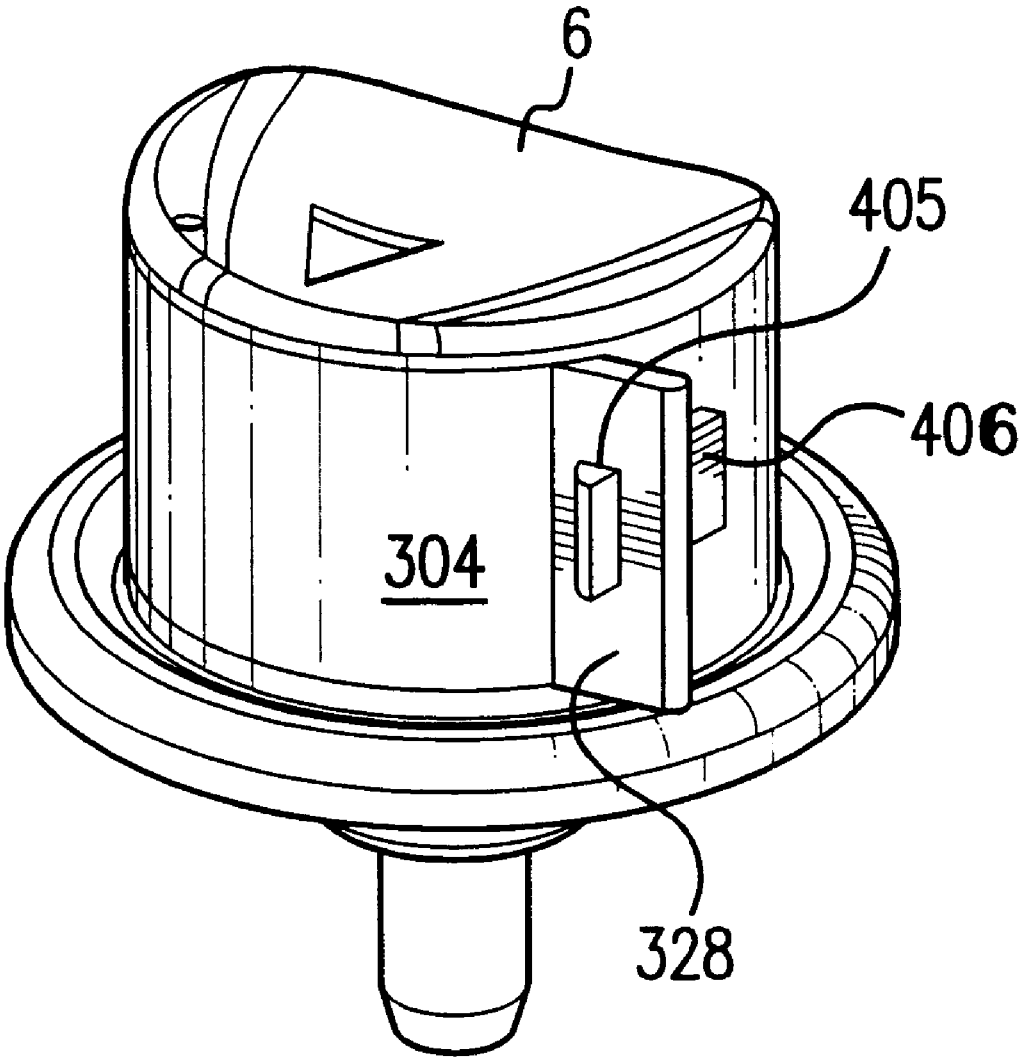
FIG. 11 is a perspective view of a nozzle closure, in a closed position, according to a further embodiment of the present invention.
Figure 12:
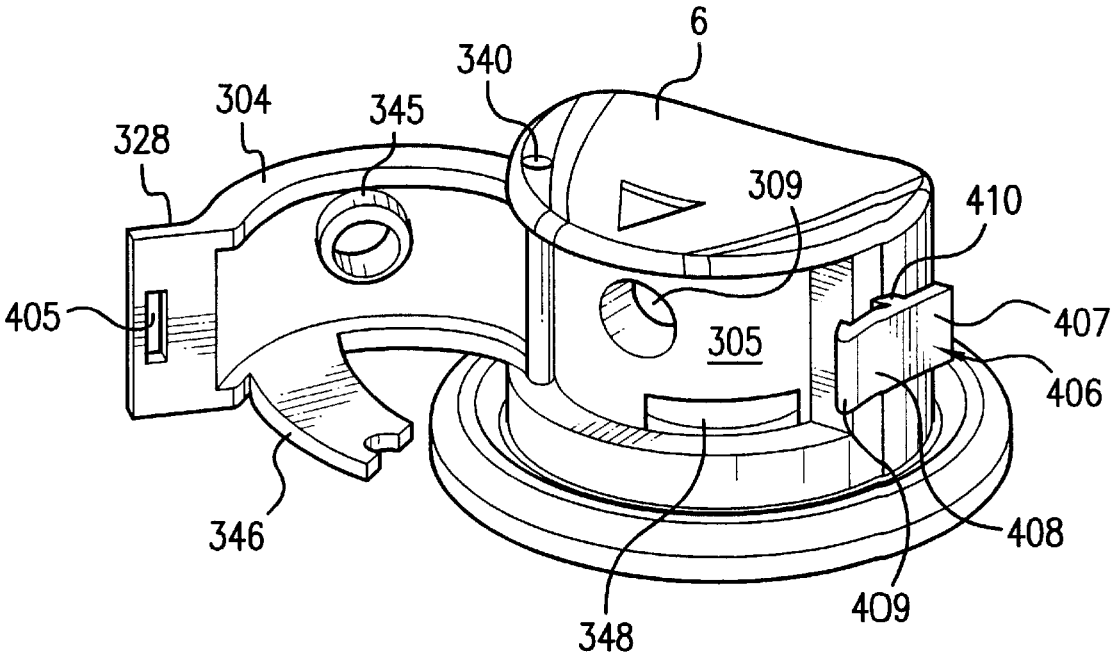
FIG. 12 is a perspective view of the nozzle closure, in an open position, according to the embodiment of FIG. 11.

Another specific example of an embodiment of the present invention used with an aerosol valve is shown in FIGS. 11–12. While similar to the embodiment discussed with reference to FIGS. 8–10, in this embodiment, actuator 6 may also include locking tab 406. When sealing finger 304 is in the closed position, as depicted in FIG. 11, for example, annular sealing rim 345 may engage within spray opening 309, and locking projection 346 may fit into, and extend within, opening 348 to prevent actuation of actuator 6 and the accompanying dispensing of spray. Additionally, locking tab 406 may engage operating tab 328 to prevent operation of sealing finger 304 from the closed position to the open position. In an embodiment, operating tab 328 may include opening 405, and locking tab 406 may include, for example, posterior portion 407, anterior portion 408 with locking flange 409, and support post 410. In one embodiment, locking tab 406 may be molded as an integral component of actuator 6, while in another embodiment, locking tab 406 may be separately formed and subsequently attached to actuator 6. In the latter embodiment, support post 410 may be fixedly attached to actuator 6 using a variety of attachment means, including, for example, adhesive, press fit, snap fit, etc. It may be recognized that other embodiments of locking tab 406 and operating tab 328 are contemplated.

When it is desired to dispense spray from aerosol container 302, sealing finger 304 may be pivoted away from actuator 6 and spray orifice 309, to the open position shown in FIG. 12, for example, by pressing on posterior portion 407 of locking tab 406 and rotating sealing flange 304 outwardly about hinge 340. Thereafter, actuator 6 may be depressed and spray may exit spray orifice 309 through spray opening 325. Pressing on posterior portion 407 of locking tab 406 pivots locking tab 406 about support post 410 and disengages anterior portion 408, and specifically locking flange 409, from operating tab 328. In this embodiment, opening 405 may be large enough to allow locking flange 409 to pass through without obstruction. Advantageously, the operation of sealing finger 304 from the closed position to the open position may typically require the use of two hands, one hand to disengage locking tab 406 from operating tab 328 and one hand to pivot sealing finger 304 away from actuator 6. Additionally, the material composition and physical dimensions of support post 410 may determine the amount of force required to pivot locking tab 406 about support post 410 to disengage locking tab 406 from operating tab 328. In this manner, a level of child-resistance may be imparted to actuator 6.

Similarly, after dispensing, sealing finger 304 may be pivoted towards spray orifice 309, so that annular sealing rim 345 engages within spray orifice 309, locking projection 346 engages within opening 348, and locking tab 406 engages with operating tab 328. The engagement of annular sealing rim 345, with spray orifice 309, seals spray orifice 309 from the encroachment of air or other debris, thereby preventing clogging of the spray orifice 309 between dispensing strokes. So, for example, in the closed position shown in FIG. 11, sealing finger 304 completely fills spray opening 305 and covers spray orifice 309. And, the engagement of locking projection 346 with opening 348 advantageously prevents actuator 6 from being depressed, thereby locking actuator 6 against accidental discharge.

Several embodiments of the present invention are specifically illustrated and described herein. However, it will be appreciated that modifications and variations of the present invention are covered by the above teachings and within the purview of the appended claims without departing from the spirit and intended scope of the invention.

What is claimed is:

1. An apparatus, comprising:

an actuator, including:

a spray nozzle, a first opening adjacent to the spray nozzle, a second opening below the first opening, and a downwardly extending projection, in fluid communication with the spray nozzle, to sealingly engage an upwardly projecting stem of an aerosol valve;

a nozzle closure, including:

a first projection, fitting into the first opening, to seal the spray nozzle when the nozzle closure is in the closed position, a second projection, fitting into the second opening and interposing between the downwardly extending projection of the actuator and the aerosol valve, to prevent actuation of the actuator when the nozzle closure is in the closed position, and a hinge, mounted to the actuator, to allow pivotal movement of the nozzle closure from an open position, at which the spray opening is open, to a closed position, at which the spray opening is closed and the first and second projections engage the first and second openings, respectively.

2. The apparatus of claim 1, wherein the hinge pivots about an axis parallel to a direction of actuation of the actuator.

3. The apparatus of claim 1, wherein the first projection is an annular sealing rim.

4. The apparatus of claim 1, wherein the second projection is tapered.

5. The apparatus of claim 4, wherein an end of the second projection is concave.

6. The apparatus of claim 1, the nozzle closure further including an operating tab.

7. The apparatus of claim 6, the actuator further including a locking tab to engage the operating tab.

8. The apparatus of claim 7, the operating tab further including a third opening and the locking tab further including an end having a locking flange to engage the third opening.

9. The apparatus of claim 1, wherein the closed position defines a press fit between the actuator and at least one of the nozzle closure, the first projection and the second projection.

10. An aerosol dispenser, comprising:

a closed container;

a mounting cup, attached to the closed container, having an aerosol valve with an upwardly projecting stem;

an actuator, including:

a spray nozzle, a first opening adjacent the spray nozzle, a second opening below the first opening, and a downwardly extending projection, in fluid communication with the spray nozzle, to sealingly engage the upwardly projecting stem; and a nozzle closure, including:

a first projection, fitting into the first opening, to seal the spray nozzle when the nozzle closure is in the closed position, a second projection, fitting into the second opening and interposing between the downwardly extending projection of the actuator and the aerosol valve, to prevent actuation of the actuator when the nozzle closure is in the closed position, and a hinge, mounted to the actuator, to allow pivotal movement of the nozzle closure from an open position, at which the spray opening is open, to a closed position, at which the spray opening is closed.

11. The aerosol dispenser of claim 10, wherein the hinge pivots about an axis parallel to a direction of actuation of the actuator.

12. The aerosol dispenser of claim 10, wherein the first projection is an annular sealing rim.

13. The aerosol dispenser of claim 10, wherein the second projection is tapered.

14. The aerosol dispenser of claim 13, wherein an end of the second projection is concave.

15. The aerosol dispenser of claim 10, the nozzle closure further including an operating tab.

16. The aerosol dispenser of claim 15, the actuator further including a locking tab to engage the operating tab.

17. The aerosol dispenser of claim 16, the operating tab further including a third opening and the locking tab further including an end having a locking flange to engage the third opening.

18. The aerosol dispenser of claim 10, wherein the closed position defines a press fit between the actuator and at least one of the nozzle closure, the first projection and the second projection.

19. A nozzle closure for an actuator, comprising:

a first projection, fitting into a first opening in the actuator, to seal the actuator when the nozzle closure is in a closed position, a second projection, fitting into a second opening in the actuator and interposing between a downwardly extending projection of the actuator and an upwardly projecting stem of an aerosol valve, to prevent actuation of the actuator when the nozzle closure is in the closed position, and a hinge, mounted to the actuator, to allow pivotal movement of the nozzle closure from an open position, at which a spray opening of the actuator is open, to the closed position, at which the spray opening is closed.

20. The nozzle closure of claim 19, further including an operating tab.

21. The nozzle closure of claim 20, wherein the operating tab engages an actuator locking tab.

22. The nozzle closure of claim 21, the operating tab further including a third opening to engage a locking tab flange.

23. The nozzle closure of claim 19, wherein the closed position defines a press fit between the actuator and at least one of the nozzle closure, the first projection and the second projection.

* * * * *